United States Patent [19]

Wangermann

[11] 4,125,253

[45] Nov. 14, 1978

[54] METHOD OF PROVIDING A STACK OF PREDETERMINED LENGTH AND APPARATUS FOR PERFORMING SAID METHOD

[75] Inventor: Jochen Wangermann, Appen, Fed. Rep. of Germany

[73] Assignee: Gruner & Jahr AG & Co., Schleswig-Holstein, Fed. Rep. of Germany

[21] Appl. No.: 733,043

[22] Filed: Oct. 18, 1976

[30] Foreign Application Priority Data

Oct. 22, 1975 [DE] Fed. Rep. of Germany ..... 2547298

[51] Int. Cl.[2] ..... B65H 39/06

[52] U.S. Cl. ..... 270/58; 93/93 R; 214/7; 271/243; 271/256

[58] Field of Search ..... 270/58; 93/93 R, 93 M, 93/93 C; 214/6 D, 6 C, 7, 6 TS

[56] References Cited

U.S. PATENT DOCUMENTS

| | | | |
|---|---|---|---|
| 3,655,180 | 4/1972 | Holler | 270/58 |
| 3,995,748 | 12/1976 | Looney | 214/6 D |
| 4,030,528 | 6/1977 | Horning | 214/6 TS |

*Primary Examiner*—Edgar S. Burr
*Assistant Examiner*—A. Heinz
*Attorney, Agent, or Firm*—Andrus, Sceales, Starke & Sawall

[57] ABSTRACT

From a printing machine a stream of printing products is received. To build up a stack of predetermined length a plurality of part-stacks is successively composed from the incoming stream. Each of the part-stacks comprises at least one product. The total number of products within the plurality of part-stacks is adjusted so as to correspond to the predetermined length of the stack to be built up. If said plurality of part-stacks having said total number has been successively composed these part-stacks are combined to form the total stack having the predetermined stack length.

21 Claims, 7 Drawing Figures

METHOD OF PROVIDING A STACK OF PREDETERMINED LENGTH AND APPARATUS FOR PERFORMING SAID METHOD

BACKGROUND OF THE INVENTION—FIELD OF THE INVENTION

The present invention relates to a method of building up a stack of predetermined length composed of printing products discharged from a printing machine.

BACKGROUND OF THE INVENTION—DESCRIPTION OF THE PRIOR ART

The U.S. Pat. Application Ser. No. 705,719 of applicant, filed July 15, 1976, relates to a system for storing printing products discharged from a printing machine and for transporting said printing products to a further-treatment machine comprising at least one rigid transport stand for receiving at least one compressed stack and at least one movable gripping device having at least a pair of spaced gripping fingers relatively movable with respect to each other, which are adapted to grip a predetermined number of printing products from the printing machine and to maintain it compressed to such a degree that the gripping fingers with the stack clamped therebetween may be introduced into grooves of the transport stand. In U.S. Pat. Application Ser. No. 705,719 it is stressed to be a substantial advantage of transport stand and gripping device that the part-products are no longer compressed to a different extent, so that their folding state is the same during further treatment operations and is thus reproducible.

SUMMARY OF THE PRESENT INVENTION

In further developing the subject matter of the previously mentioned application, the present invention relates to a specific method for providing a stack of printing products of predetermined length, which corresponds to the internal dimensions of the transport stands used, wherein gradual variations in thickness of the paper used for printing of the printing products can be compensated.

In accordance with the present invention, this object is solved in that from the products a plurality of part-stacks, each of which comprises at least one product, with a total number of products corresponding to the predetermined stack length is successively composed and in that said part-stack are combined to form the total stack of predetermined length.

Preferably, a predetermined number of part-stacks is provided all but one of which comprise a constant number of products, and the number of products of the remaining stack is adjusted so that the total number of products corresponding to the predetermined stack length is achieved.

Expediently, for adjusting the number of products of the remaining part-stack, the heights of the part-stacks with a constant number of products should be determined and added, the sum thus achieved should be compared with the predetermined stack length, and the number of products in the remaining stack determined from the difference therebetween.

Further method claims relate to advantageous embodiments of the method as according to the present invention.

The present invention also relates to an apparatus for preforming the method.

In accordance with the present invention, said apparatus is characterized by counting means for counting the products discharged from the printing machine; means for interrupting the flow of products; means for forming part-stacks, which is connected to the outlet side of said latter means and includes a transporting element index-wise movable by drive means and having a plurality of successive transport regions, wherein in one indexing position of the transporting element an abutment for forming stacks is associated to at least one transport region, means for determining the part-stack height is associated to a second transport region, means for removing the part-stacks from the transporting element is associated to a third transport region; means connected to the outlet side of the part-stack forming means and provided for storing the part-stacks until completion of the stack of predetermined length; and a control and computing unit which is connected with said counting means, said product flow interrupting means, said drive means of said transporting element, said height determining means and said part-stack removal means.

Preferably, the index-wise movable transporting element comprises star transporting means rotatable about a substantially horizontal axis and having a plurality of indented pockets serving for forming and transporting of part-stacks.

Further apparatus claims refer to advantageous embodiments of the apparatus as according to the present invention.

BRIEF DESCRIPTION OF THE DRAWING

The present invention will now be described in detail with reference to the attached drawings. In the drawings.

DETAILED DESCRIPTION OF THE PREFERRED EMBODIMENT

Figure 1A:
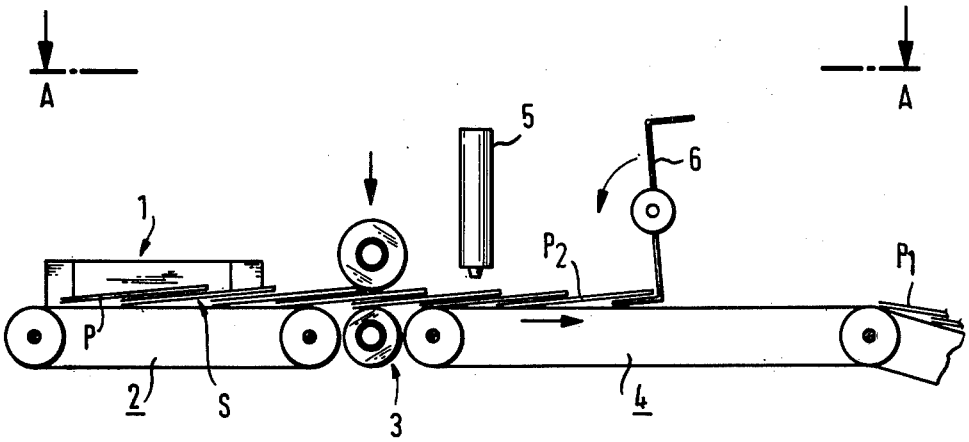
FIGS. 1*a*,1*b* are schematic side views of the apparatus as according to the invention, FIG. 1*a* showing the left hand portion of the apparatus and FIG. 1*b* showing the right hand portion of the apparatus.
Figure 2A:
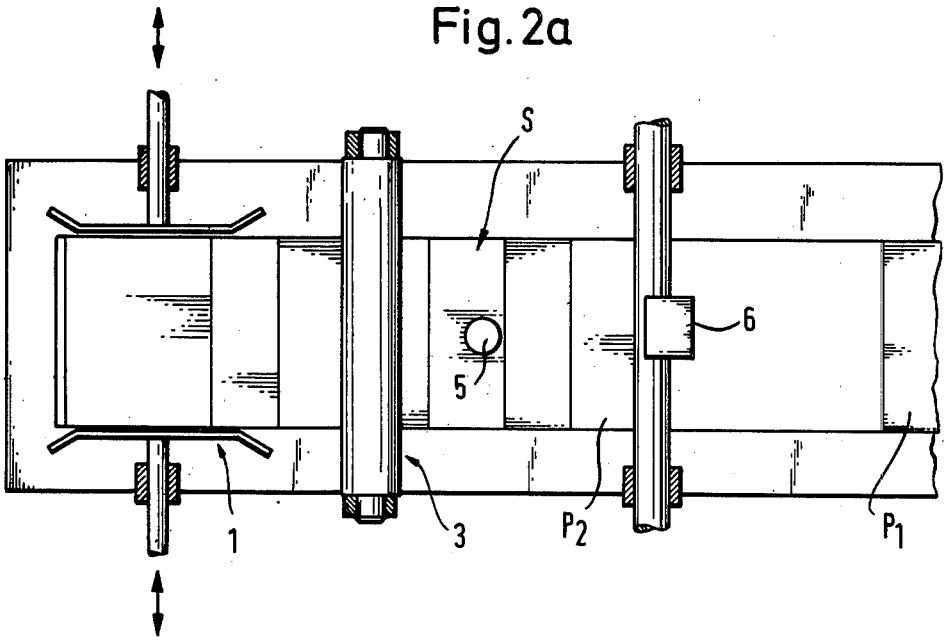
FIGS. 2*a*,2*b* are sectional views through line A—A of FIGS. 1*a* and 1*b*, respectively.

As shown in FIGS. 1*a* and 2*a*, the product-by-product stream S of overlapping products P discharged from the folder of a printing machine in the direction of the arrow (from the left) is first laterally aligned by an aligning means schematically shown at 1. The product-by-product stream S thus aligned and conveyed by a conveyor belt 2 is then precompressed between a pair of press rollers 3 and thereafter moved to a further conveyor belt 4. Above the conveyor belt 4 a product counter 5 is located which may be an optical counter, for example. The counter 5 is shown only schematically, since such devices are conventional and available on the market. Above the conveyor belt 4 there is further located a vane-like interrupting means 6 to interrupt the product-by-product stream S. The systems of lateral alignment, precompression, product counting and interruption of the product-by-product stream S are known with packet deliverers.

After the conveyor band 4 a star transporting means 7 is arranged. The star transporting means 7 comprises at least two, preferably three indented discs 8,9,10. Together these three discs form eight indented pockets 11. In the embodiment as shown each pocket comprises a wide terminating plane 11*a* and a narrow terminating plane 11*b*. Perpendicularly to the terminating plane 11*b* and parallel to the terminating plane 11*a* of each pocket a supporting shoulder 11*c* extends from the indentation tip of the associated indentation. The planes 11*b* extend radially with respect to shaft 12 carrying the three discs 8,9 and 10, whereas the planes 11*a* extend perpendicularly to the planes 11*b*. Regarding the individual configurations of the discs 8,9 and 10, reference is expressly made to FIG. 1*b*.

Figure 1B:
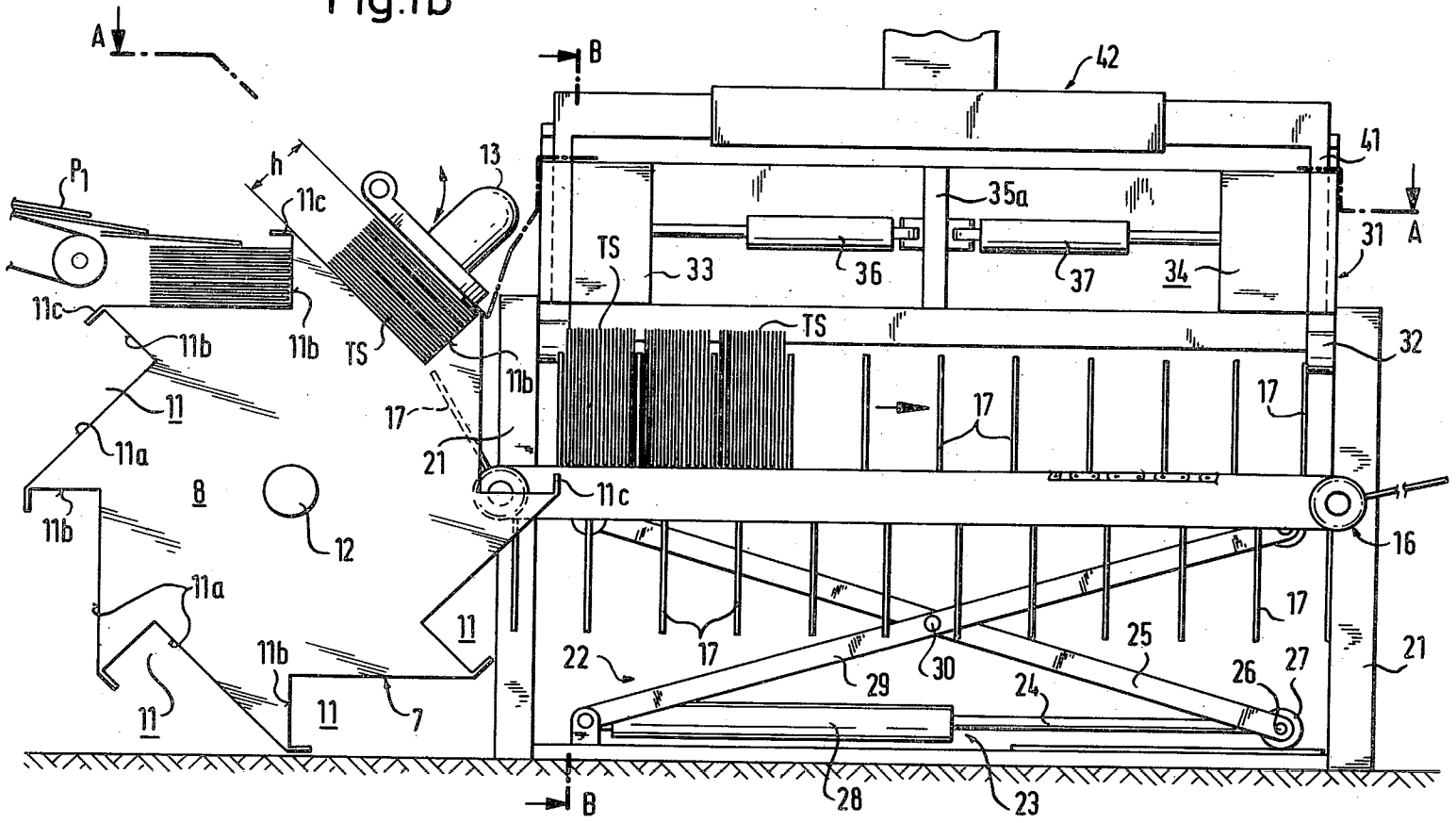

Further, a gauging device 13 is provided for gauging the height *h* of a part-stack TS resting in an indented pocket. In the embodiment as shown in FIG. 1*b*, the part-stack gauging device 13 includes a pin adapted to be urged with a predetermined pressure against the part-stack TS with the plane 11*a* of the star transporting means 7 serving as defined support surface. A sensor (not shown) associated with the pivotable pin detects the position of the pin and feeds the result to a control and computing unit 14.

Figure 2B:
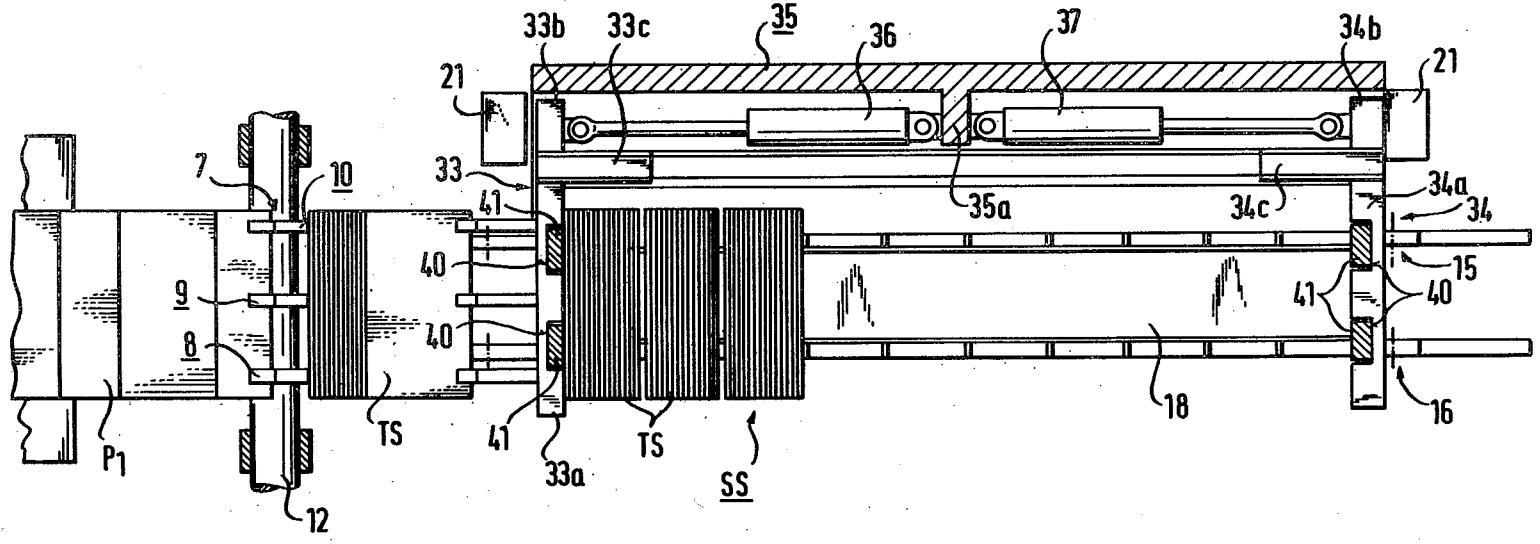
Figure 3:
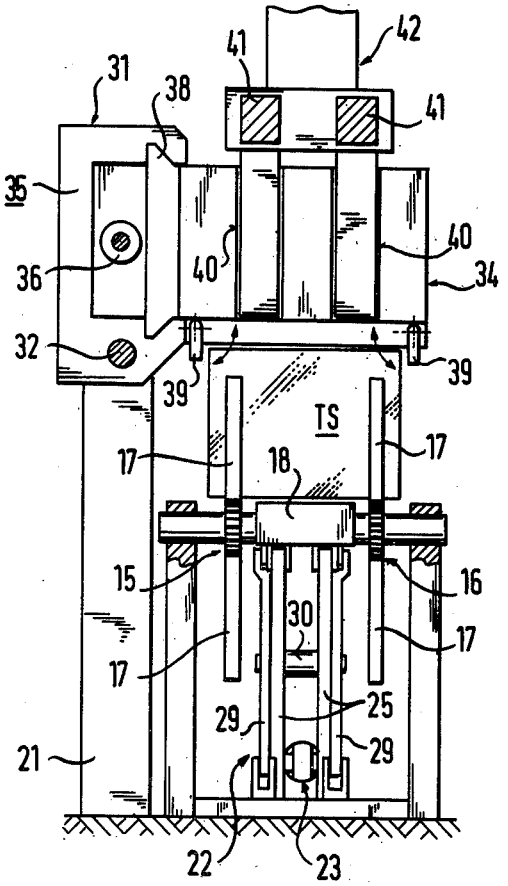
FIG. 3 is a sectional view through line B—B of FIG. 1*b*.
Figure 4:
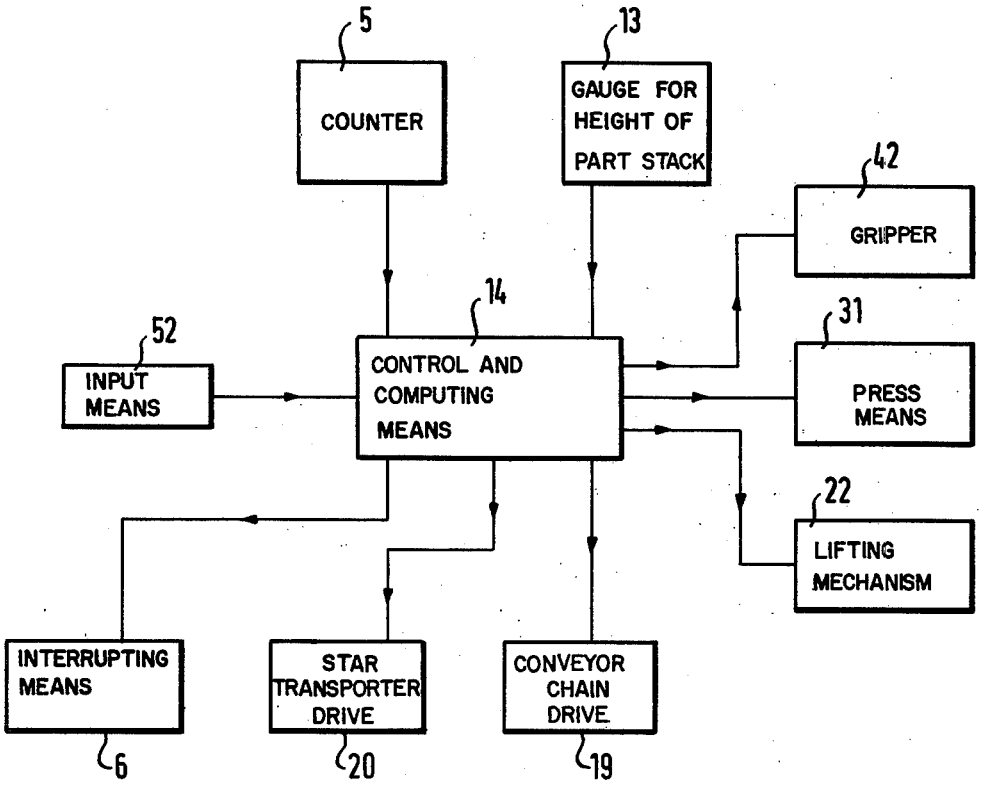
FIG. 4 is a block diagram for representing the cooperation of the various measuring means and drive means with the control and computing unit.

As shown in FIGS. 1*b*,2*b* and 3, two parallel extending endless part-stack conveyor chains 15 and 16 project between the discs 8,9 and 10 of the star transporting means. The two part-stack conveyor chains are spaced apart so that on the one hand they can positively grip with their engaging fingers 17 the part-stack TS to be removed from the star transporting means and that on the other hand there is enough space left between them for a stack carrier 18. The part-stack conveyor chains 15 and 16 comprise roller chains, on which the narrow rigid engaging fingers 17 are mounted. The drive for the part-stack conveyor chains 15 and 16 (shown only schematically in FIG. 4 at 19) and the drive of the star transporting means 7 (only schematically shown in FIG. 4 at 20) are so controlled by the control and computing unit 14 that the star transporting means and the part-stack conveyor chains move indexwise and at a predetermined timed relation with respect to each other.

The stack carrier 18 is adapted to be reciprocated in vertical direction within a machine frame 21 by a lifting mechanism 22. In accordance with the embodiment as shown, the lifting mechanism 22 comprises a piston/cylinder drive 23 secured to the frame. The piston rod 24 of the piston/cylinder drive is pivotally connected to at least one pair of bars 25, the connecting bolt 26 carrying a roller 27 rolling on the bottom portion of the frame. The cylinder 28 of the piston/cylinder drive is pivotally connected to the frame 21.

In the area of the pivot point a further pair of bars 29 is pivotally connected. The pairs of bars 25 and 29 are centrically connected to each other by a pivot pin 30. The free ends of the pair of bars 29 support via one or a plurality or rollers the stack carrier 18, whereas the free ends of the other pairs of bars 25 are pivotally connected to the stack carrier 18. Upon actuation of the piston/cylinder drive 23 for retracting the piston rod 24 the stack carrier 18 is raised in vertical direction by the cross-bar arrangement as described above.

On the machine frame 21 press means 31 are pivotally supported about an axis 32, so that the pressing jaws 33 and 34 of the press means 31 can be pivoted over the stack conveyor chains 15 and 16 and the stack carrier 18 or retracted from this position.

As shown especially in FIGS. 2*b* and 3, the pressing jaws 33 and 34 are movably guided in a base member 35 of the press means 31 and are of T-shaped configuration, with the beam sections thereof being of different length. The longer sections 33*a* and 34*a* are provided to engage the stack SS composed of a plurality of part-stacks TS, whereas the smaller beam sections 33*b* and 34*b* are connected to the piston rods of piston cylinder drives 36 and 37, respectively, whose cylinders are connected to a land 35*a* of the base member 35. The pressing jaws 33 and 34 guided by the T's stem sections 33*c* and 34*c*, respectively, are therefore capable of being actuated towards each other.

In the working position of the press means 31, extensions 38 of the base member 35 straddle over the conveyor chains. Between said extensions there are pivotally supported bar holders 39 extending in parallel to the conveying direction of the part-stack conveyor chains 15 and 16. They are adapted to be pivoted from the position as shown in FIG. 3, in which upon lifting the stack SS can be moved between them, to a position, in which they extend substantially horizontally and are capable of carrying the stack SS, as will be described below.

As shown especially in FIG. 2*b*, the portions 33*a* and 34*a* of the pressing jaws 33 and 34 are provided at their opposing faces with recesses 40 into which the gripping fingers 41 of a gripper 42 can be introduced from above (see FIG. 3). Also the gripping fingers are adapted to be actuated towards each other. For this purpose, the gripper 42 may also be provided with a piston/cylinder drive. Other possibilities of actuation are conceivable. The recesses 40 correspond in their cross-section to the cross-section of the gripping fingers 41.

Prior to setting forth the operation of the apparatus as described above a modified embodiment of the means for part-stack removal from the star transporting means will be described with reference to FIG. 5.

Figure 5:
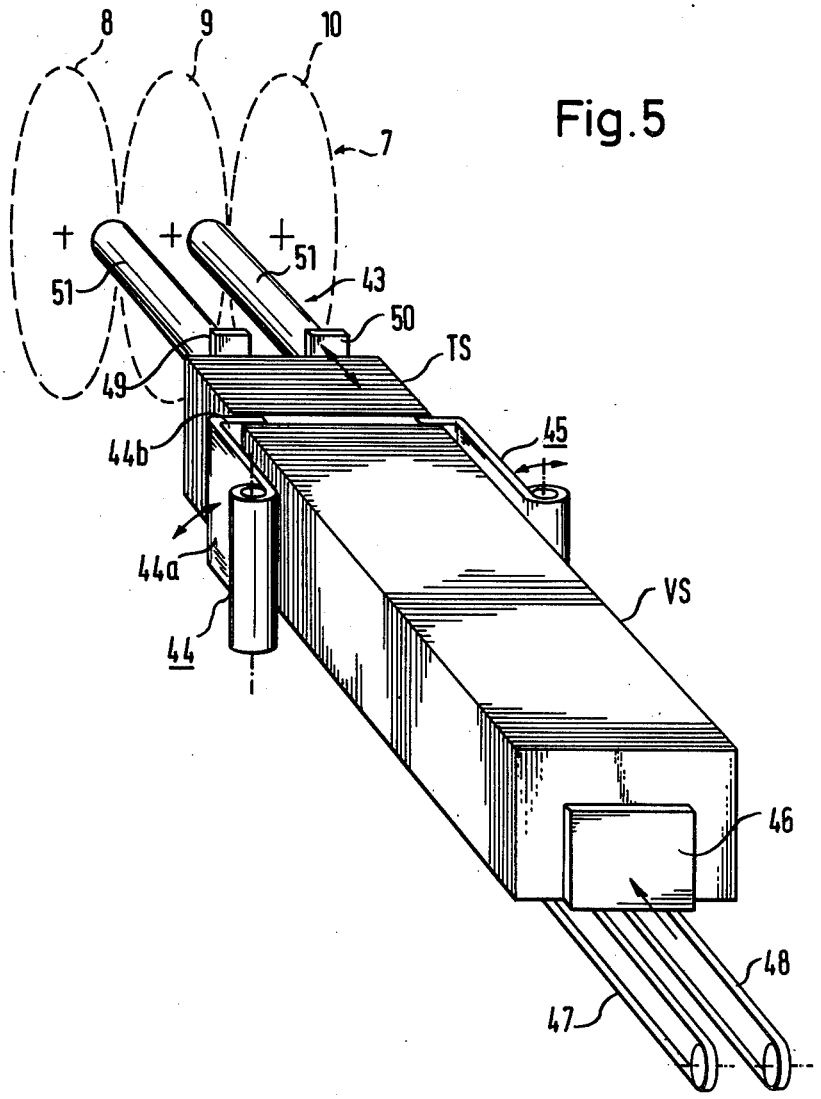
FIG. 5 views means for removing and storing the part-stacks deviating from that shown in the apparatus as according to FIGS. 1*a*-2*b*.

While in the arrangement as according to FIGS. 1*b* and 2*b* the part-stacks TS are maintained apart by the engaging fingers 17 of the sub-stack conveyor chains 15 and 16 until the lifting means are actuated and thus the sub-stacks TS move out of engagement with the conveyor chains, in the arrangement as shown in FIG. 5 each part-stack TS removed from the star transporting means 7 (shown only schematically as three circles) by a pusher mechanism 43 is added to a preliminary stack VS composed of previously joined part-stacks TS. To achieve this, there is provided for the end of the preliminary stack VS facing the star transporting means a holding means in the form of a pair of pivotally arranged bracket holders 44 and 45, the holding portion 44*a* and 44*b* of which are adapted to be moved out of engagement with the preliminary stack VS upon ejection of a new part-stack TS by the pusher mechanism 43. After pivoting the two bracket holders 44 and 45 from their holding position to their release position the pusher mechanism 43 can discharge the part-stack TS together with the preliminary stack VS against the force of a (possibly spring-actuated) abutment 46. Prior to retracting the pusher mechanism 43 back to its neutral position the bracket holders 44 and 45 are pivoted back to their holding position, so that upon retraction of the pusher mechanism 43 the end of the preliminary stack VS or, respectively, — after ejection of the last part-stack TS — of the stack SS facing the star transporting means 7 is secured. The abutment 46 is guided between two bars 47 and 48. Between the bars also a stack carrier to be lifted by a lifting means may be disposed.

According to the embodiment as shown in FIG. 5, the pusher mechanism comprises two plungers 49,50 each extending between the discs 8 and 9 and 9 and 10, respectively, and having pushing faces at their working ends, which pushers may be advanced from and retracted into double-acting piston/cylinder drives 51 as schematically shown for example in FIG. 5.

DESCRIPTION OF OPERATION ACCORDING TO FIGS. 1*a* TO 4

The product-by-product stream continuously fed by means of conveyor belts from the folding apparatus of the printing machine is — upon reaching the stack deliverer— first laterally aligned (at 1), compressed (at 3) and counted (at 5). It is possible, for example, to feed 45,000 copies with 40 pages each per hour. In accordance with the embodiment of FIG. 1, ten part-stacks TS are provided to build up the stack SS, so that at the upper end of the conveyor chains 15 and 16 ten spacings each are straddled by the pressing jaws 33 and 34 and the gripper 42. Regarding the first nine part-stacks TS, the control and computing unit was fed with the number Z of products per part-stack. This can be achieved through an input means shown at 52 in FIG. 4.

In the following description, it was assumed that the star transporting means 7 is initially in the position as shown in FIG. 1*b* in which a pocket 11 with horizontal terminating plane 11*a* and vertical terminating plane 11*b* is at the end of the conveyor belt 4, so that the products P fed by the conveyor belt 4 may rest on the edge faces of the discs 8,9,10 defining the terminating plane 11*a* and abut against the edges defining the plane 11*b* and are thus capable of forming a part-stack TS in the indented pocket 11.

When the predetermined number Z of products P per part-stack TS is reached, the product-by-product streams S is interrupted by pivoting the interrupting means 6 through 90° in the direction indicated in FIG. 1*a*. Since the conveyor belt 4 continuously moves on, a gap is formed in the product-by-product stream S. When the gap has reached an appropriate width, the interrupting means 6 further pivots through 90° in the same direction and releases the stream S again. During the period of interruption by the interrupting means 6 the products fed by the conveyor belts 2 and 4 have accumulated at the interrupting means 6 so that the distance between the individual products has lessened. When the last product $P_1$ before the gap has been delivered to the indented pocket 11 being in its filling position and has settled against the edges of discs 8,9 and 10 defining the plane 11*b* of the pocket 10 to be filled and forming an abutment, the star transporting means 7 is rotated clockwise through 45°, so that a further empty indented pocket 11 is advanced to filling position. This rotational step must be completed before the first product $P_2$ after the gap reaches the filling position.

By rotating the star transporting means 7 the just completed part-stack TS is moved to the working area of the part-stack gauging device 13. The pin is urged against the part-stack TS and the sensor (not shown) gauges the pin's position and thus the height *h* of the part-stack TS. A signal representative of the height *h* is fed to the control and computing unit 14 where it is stored. When the part-stack composed in the subsequent pocket has reached the predetermined number of products the star transporting means 7 is again rotated through 45° so that the gauged part-stack TS reaches the discharging position. When rotating the star transporting means the part-stack is, during its incoming motion, moved into contact with the part-stack conveyor chains 15 and 16 and removed from the indented pocket 11 of the star transporting means. Upon movement of the star means 9 the part-stack conveyor chains 15 and 16 advance with the part-stack TS engaged by their engaging fingers 17 away from the star transporting means 7 through a predetermined distance, so that upon a further rotation of the star transporting means 7 a gauged part-stack TS reaches its discharging position. In the state as shown in FIG. 1*b* already three part-stacks TS have been engaged by the conveyor chains and moved onto the stack carrier 18. One part-stack is in the gauging position 31, and in the filling position three products have still to be deposited on the part-stack forming in the pocket being in its filling position. According to the embodiment shown, a stack of products one meter in length and composed of ten part-stacks is to be formed, so that the predetermined position of the pin corresponds to a height *h* equal 0,100 m (of compressed sheets). The computing means compare the gauged position with the predetermined one and correct the number of products reaching the filling position. In the embodiment, the computing means add the gauged part-stack heights *h* of the first nine part-stacks and correct by means of the product counter 5 and the interrupting means 6 the number of products of the tenth part-stack (last part-stack) such that the desired, predetermined length of the product stack (± thickness of one sheet or product) in the compressed state of the product stack referred to below is achieved. Thus, gradual variations in paper thickness can be automatically compensated, which is not possible when only counting the products without any gauging and comparing.

When the desired ten part-stacks TS have been combined on the stack carrier 18, the part-stacks TS are lifted from the spacings between the engaging fingers 17 of the part-stack conveyor chains 15 and 16 upwardly into the press means 31 being in working position by actuating the lifting means 22. This is achieved by correspondingly actuating the piston/cylinder drive 23. Thereupon the bar holders 39 are pivoted inwardly towards each other to hold the product stack in its position between the pressing jaws 33 and 34 of the pressing means 31 upon re-descending the lifting means 22. The gripping fingers 41 of the gripper 42 are inserted into the recesses 40. The pressing jaws 33 and 34 of the pressing means 31 are actuated towards each other and compress the product stack SS. The actuating means effecting the approach of the gripping fingers 41 is not actuated in opposite direction, so that when the pressing jaws are approaching each other, the gripping fingers 41 can be moved therewith. The gripping fingers inserted into the recesses 40 provide with the pressing jaws an almost continuous, plane pressing surface. When the desired state of compression of the product stack SS is achieved the gripping fingers 41 of the gripper 42 are so actuated towards each other that they are capable of holding the compressed stack SS, while the pressing jaws 33 and 34 move away from each other by correspondingly actuating the piston/cylinder drives 36 and 37. The gripper 42 may now transfer the compressed stack SS to a transport stand as according to U.S. Application Ser. No. 705,719, in which stand it releases the stack towards the side walls of the transport stand so that this stack is held between the walls of the transport stand in a partially compressed state. Thereupon the gripper 42 may be returned to the pressing means.

Since the pressing means is arranged for pivotal movement about an axis parallel to the conveying direction of the stack conveyor chains 15 and 16, it is adapted to be moved to a neutral position, with the gripping fingers being of course retracted from the pressing jaws. Then there is the possibility of manually removing the individual part-stacks TS from the part-stack conveyor chains and depositing them on pallets, conventionally. When adopting this practice, it is useful to provide that the part-stack conveyor chains 15 and 16 advance two steps for the removal of each part-stack from the star transporting means, so that on the chains a gap is provided between the part-stacks TS facilitating manual removal of the part-stacks TS. In such case, a constant number of products Z per part-stack for all part-stacks is fed into the control and computing unit, and the substack gauging device 13 is not operated. The star transporting means then serves exclusively for forming stacks with a constant number of products and conveying the completed part-stack TS from the filling position to the part-stack removal position.

It is also referred to the fact that with the previously mentioned machine speed of 45,000 copies per hour each thereof having forty pages an indexing interval for the indexed rotation of the star transporting means 7 of about eight seconds results. Such indexing interval provides that the various functions of the apparatus as according to this invention can be easily fulfilled. Finally, it should be noted that the mackled sheets may be either removed manually from the gauging station represented by the part-stack gauging device 13 or diverted before the conveyor belt 2 by diverting means.

It is also conceivable that the roller chains with engaging fingers are not driven themselves, but that each part-stack is discharged by a pusher mechanism disposed between the discs of the star transporting means and engaging the engaging fingers and that the substacks TS already engaged by the chains are advanced upon each discharging motion of the chain.

The mode of operation of the arrangement as shown in FIG. 5 should be clear: the operating cycle of the pusher mechanism is— in a similar way as the part-stack conveyor chains 15 and 16 — coupled with the operating cycle of the star transporting means 7.

What is claimed is:

1. A method of forming a stack of predetermined length from a predetermined number N of part stacks, each having a plurality of relatively flat products, said method comprising the steps of:

forming N minus 1 part stacks with each of the part stacks having a predetermined number of products;

measuring the length of said N minus 1 part stacks normal to the planes of the flat products;

ascertaining the difference between the predetermined length and the combined length of said N minus 1 part stacks;

forming the Nth part stack with a variable number of products determined in accordance with said ascertained length difference so that the total length of N part stacks equals the predetermined length; and combining the N part stacks into a final stack having the predetermined length.

2. The method as in claim 1 wherein the measuring step is further defined as measuring the length of each of the N minus 1 part stacks normal to the planes of the flat products and totaling the length of the N minus 1 part stacks and wherein the ascertaining step is further defined as ascertaining the difference between the predetermined length and the length of said N minus 1 part stacks.

3. The method as in claim 1 characterized in that the part stacks are sequentially formed and said part stacks are sequentially combined into the final stack.

4. Method as in claim 1, characterized in that the part-stacks are maintained spaced-apart while being combined to form the final stack.

5. Method as in claim 1, characterized in that the part-stacks contact each other while being combined to form the final stack.

6. Method as in claim 1, characterized in that upon completion the final stack composed of the N part-stacks is compressed parallel to its length.

7. Apparatus for forming a stack of predetermined length from a plurality of relatively flat products moving sequentially along a path, said apparatus comprising:

a counter (5) for counting the number of products moving sequentially along the path;

interrupting means (6) for interrupting the movement of said products along said path to form said products into groups of numbers of products;

a transporting element (8,9,10) having means for receiving said groups of products and forming part stacks therefrom, said transporting element being movable to a plurality of positions, in a first of which said groups are received and said part stacks formed;

measuring means (13) operatively associated with said transporting element for measuring the length of said part stacks normal to the planes of said flat products when said transporting element is in a second position;

removing and storing means (17,18;43,46) operatively associated with said transporting element when said transporting element is in a third position for removing said part stacks and for storing same; and control means coupled to said counter and measuring means for operating said interrupting means, transporting element, and removing and storing means for providing N minus 1 part stacks, each having a predetermined number of products and an Nth part stack having a number of products sufficient to form a final stack of N part stacks having a predetermined length normal to the planes of said flat products.

8. The apparatus as in claim 7 wherein said removing and storing means comprises conveyor means positioned with respect to said transporting element to receive part stacks therefrom when said transporting element is in said third position, said conveyor means having engaging fingers spacedly mounted therealong to sequentially remove part stacks from said transporting element and place them on said conveyor means.

9. Apparatus as in claim 7 characterized in that said movable transporting element (7) comprises a star transporting means rotatable about a substantially horizontal axis and having a plurality of indented pockets (11) provided to assist in forming and transporting of part-stacks.

10. Apparatus as in claim 9, characterized in that said star transporting means (7) comprises at least two spaced indented discs (8,9,10) arranged in parallel on one shaft (12), and that the removing and storing means includes part stack removal means (17:43) projecting between the discs.

11. Apparatus as in claim 9, characterized in that the star transporting means (7) comprises eight pockets each being defined by terminating planes (11*a*,11*b*) perpendicularly arranged with respect to each other, and is rotatable by incremental steps 45°.

12. Apparatus as in claim 9 wherein said removing and storing means includes a pusher mechanism (43) disposed within the star transporting means (7) for removing part stacks from said star transporting means (7) onto a substantially horizontally extending stack carrier, said stack carrier including holding element (44,45,46) for holding part stacks already deposited on said stack carrier.

13. Apparatus as in claim 7 wherein said removing and storing means includes pusher means positioned with respect to said transporting element to push said part stacks out of said transporting element when same is in said position and includes a stack carrier for receiving and holding the part stacks pushed from said transporting element.

14. Apparatus as in claim 7 characterized in that the removing and storing means for the part stack removed from said transporting means extends substantially horizontally and is supported for being lifted by a lifting means coupled to and operable by said control means.

15. Apparatus as in claim 14, characterized in that the lifting means (22) is a cross-bar arrangement (25,29) actuable by a piston/cylinder drive (23).

16. Apparatus as in claim 14, characterized in that above said removing and storing means and said lifting means (22), a press means (31) is disposed, which is capable of engaging the ends of the final stack (SS) with pressing jaws (33, 34) actuable towards each other by drive means (36;37), when said removing and stacking means has been lifted by said lifting means (22) so far that it lies between the pressing jaws.

17. Apparatus as in claim 16 characterized in that the pressing jaws (33,34) movable into contact with the final stack (SS) having stack contacting surfaces with at least one recess (40), said apparatus including gripping means (42) having gripping fingers (41) insertable in said recesses and actuatable towards each other by drive means for holding said final stack.

18. The apparatus as in claim 17 wherein said press means (31) and said gripping means (42) are coupled to and operable by said control means.

19. Apparatus as in claim 16, characterized in that the press means (31) includes at least two stack holders (39) adapted to be pivoted under the final stack (SS), for holding the final stack (SS) in the press means (31) before actuation of the pressing jaws (33,34) and descent of the removing and storing means.

20. Apparatus as in claim 16 characterized in that the press means (31) is pivotally supported in a machine frame (21) for movement about an axis parallel to the length of said final stack toward and away from said removing and storing means for removing said final stack.

21. Apparatus as in claim 7 further including press means operatively associated with said removing and storing means for compressively engaging the removed part stacks, parallel to their lengths for permitting displacement of the final stack of part stacks from the removing and storing means.

* * * * *